US010167705B2

(12) United States Patent
Simmons et al.

(10) Patent No.: US 10,167,705 B2
(45) Date of Patent: Jan. 1, 2019

(54) METHOD OF GAS LIFT IN WELLS EXPERIENCING HYDROSTATIC LOADING

(71) Applicant: 1773915 Alberta Ltd., Grande Prairie (CA)

(72) Inventors: Daniel Cecil Simmons, Pouce Coupe (CA); Andrew John Cepuch, Pouce Coupe (CA); Daniel Douglas Longtin, Grande Prairie (CA); Michael Bannister, Grande Prairie (CA)

(73) Assignee: 1773915 Alberta Ltd., County of Grand Prairie (CA)

( * ) Notice: Subject to any disclaimer, the term of this patent is extended or adjusted under 35 U.S.C. 154(b) by 0 days.

(21) Appl. No.: 14/709,325

(22) Filed: May 11, 2015

(65) Prior Publication Data

US 2015/0322754 A1 Nov. 12, 2015

(30) Foreign Application Priority Data

May 9, 2014 (CA) ..... 2851634

(51) Int. Cl.
*E21B 43/12* (2006.01)

(52) U.S. Cl.
CPC ..... *E21B 43/121* (2013.01); *E21B 43/123* (2013.01)

(58) Field of Classification Search
CPC ..... E21B 43/121–43/122
See application file for complete search history.

(56) References Cited

U.S. PATENT DOCUMENTS

| | | | | |
|---|---|---|---|---|
| 2,148,592 | A * | 2/1939 | Taylor | E21B 43/123 137/516.25 |
| 2,668,553 | A * | 2/1954 | Howard | E21B 43/123 137/155 |
| 3,055,306 | A * | 9/1962 | Tausch | F16K 31/08 251/65 |
| 3,175,514 | A * | 3/1965 | McMurry | E21B 43/122 137/155 |
| 6,877,965 | B2 * | 4/2005 | McCall | E21B 43/127 166/264 |
| 2006/0137881 | A1 * | 6/2006 | Schmidt | E21B 43/122 166/372 |
| 2006/0231247 | A1 * | 10/2006 | Schneider | F04B 47/12 166/68 |
| 2012/0134854 | A1 | 5/2012 | Hoshino et al. | |
| 2015/0000761 | A1 * | 1/2015 | Jefferies | E21B 34/08 137/15.08 |

* cited by examiner

*Primary Examiner* — Giovanna C. Wright
(74) *Attorney, Agent, or Firm* — Christensen O'Connor Johnson Kindness, PLLC

(57) ABSTRACT

There is provided a method of gas lift having the steps of positioning a valve seat downhole in a gas well experiencing hydrostatic loading, the valve seat having a gas flow channel, and providing a valve closure movable between a closed position engaged with the valve seat to close the gas flow channel and an open position spaced from the valve seat permitted a flow of gas through the gas flow channel, the closure being biased by magnetic attraction to a normally closed position magnetically engaged with the valve seat, such that gas is only able to flow through gas flow channel when gas pressure is sufficient to move the closure to the open position by overcoming the magnetic attraction which maintains the closure in the closed position.

4 Claims, 5 Drawing Sheets

METHOD OF GAS LIFT IN WELLS EXPERIENCING HYDROSTATIC LOADING

FIELD

There is described a method of gas lift in wells experiencing hydrostatic loading and a gas lift system in accordance with the teachings of the method.

BACKGROUND

Hydrostatic loading occurs in gas wells when gas velocity in a well diminishes to a point where it can no longer lift produced liquids to surface, resulting in low or no gas production. Plunger lift systems are commonly used to overcome hydrostatic loading. With plunger lift systems, a plunger cycles up and down as surface gas valves are opened and closed. The plunger lift system includes a bumper spring to absorb the energy of the falling plunger and a check valve that stops liquids in the production spring from falling back into the reservoir. The plunger acts as a close fitting piston which travels up and down the internal bore of the tubing string. There are also, valves on the surface well head that will open and close to control the plunger. When the well is determined to be loading, the surface valves are shut in. This causes the plunger to fall to the bottom of the tubing string and contact the bumper spring. When the plunger is resting on the bumper spring, there is a check valve in the bumper spring that stops any liquid in the tubing string from returning to the reservoir. Once it is determined that the reservoir has built up adequate pressure, the valves on surface are opened. This causes the built up gas pressure to force the plunger along with any liquid that has accumulated on top of the plunger to surface. Once the plunger reaches surface, gases are released, which then allows the plunger to return to the bottom of the tubing string to await a build-up of pressure that enables the cycle to be repeated. There will hereinafter be described a new method of gas lift, an innovative gas lift system and a gas lift plunger assembly.

SUMMARY

According to a first aspect there is provided a method of gas lift which involves positioning a valve seat downhole in a gas well experiencing hydrostatic loading, the valve seat having a gas flow channel. A valve closure movable is between a closed position engaged with the valve seat to close the gas flow channel and an open position spaced from the valve seat permitting a flow of gas through the gas flow channel. The closure is biased by magnetic attraction to a normally closed position magnetically engaged with the valve seat, such that gas is only able to flow through gas flow channel when gas pressure is sufficient to move the closure to the open position by overcoming the magnetic attraction which maintains the closure in the closed position.

It is preferred that the valve closure be configured to fall back from the open position into the closed position by force of gravity as gas pressure diminishes, rather than through the use of springs.

In one embodiment, the valve seat is a plunger receiver; and the valve closure is a plunger in the gas well that magnetically engages the plunger receiver. The plunger remains engaged with the plunger receiver by magnetic attraction, with the plunger blocking gas flow to surface, until gas pressure builds sufficiently below the plunger to overcome the magnetic attraction and propel the plunger to surface.

According to a second aspect there is provided a gas lift system which includes a gas well experiencing hydrostatic loading, a plunger receiver downhole in the gas well, and a plunger in the gas well that magnetically engages the plunger receiver. The plunger remains engaged with the plunger receiver by magnetic attraction, with the plunger blocking gas flow to surface, until gas pressure builds sufficiently below the plunger to overcome the magnetic attraction and propel the plunger to surface.

According to a third aspect, there is provide a gas lift plunger assembly which includes a plunger receiver and a plunger that magnetically engages the plunger receiver by magnetic attraction until a force is exerted to overcome the magnetic attraction.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
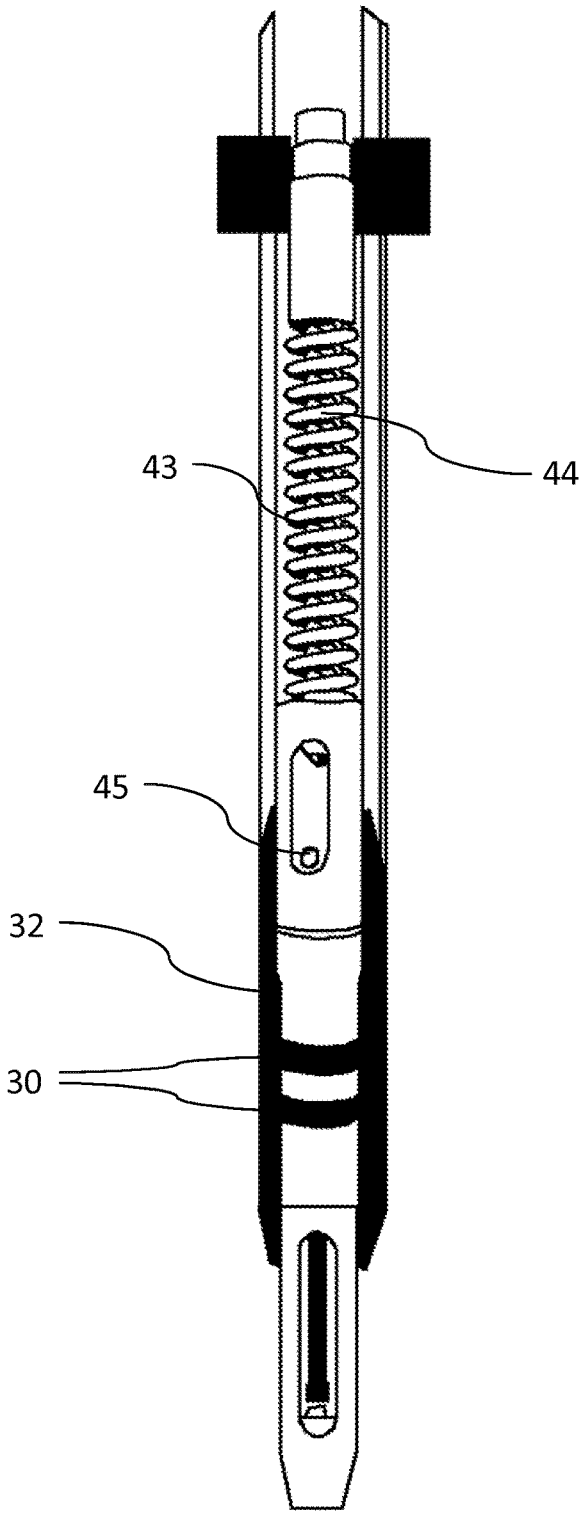
FIG. 1 is a side elevation view of a downhole valve assembly.

A first embodiment is a gas lift assembly in the form of a downhole valve generally identified by reference numeral 10, which will now be described with reference to FIGS. 1 through 3. A second embodiment is a gas lift assembly using a plunger generally identified by reference numeral 100, which will now be described with reference to FIGS. 4 and 5.

Figure 2:
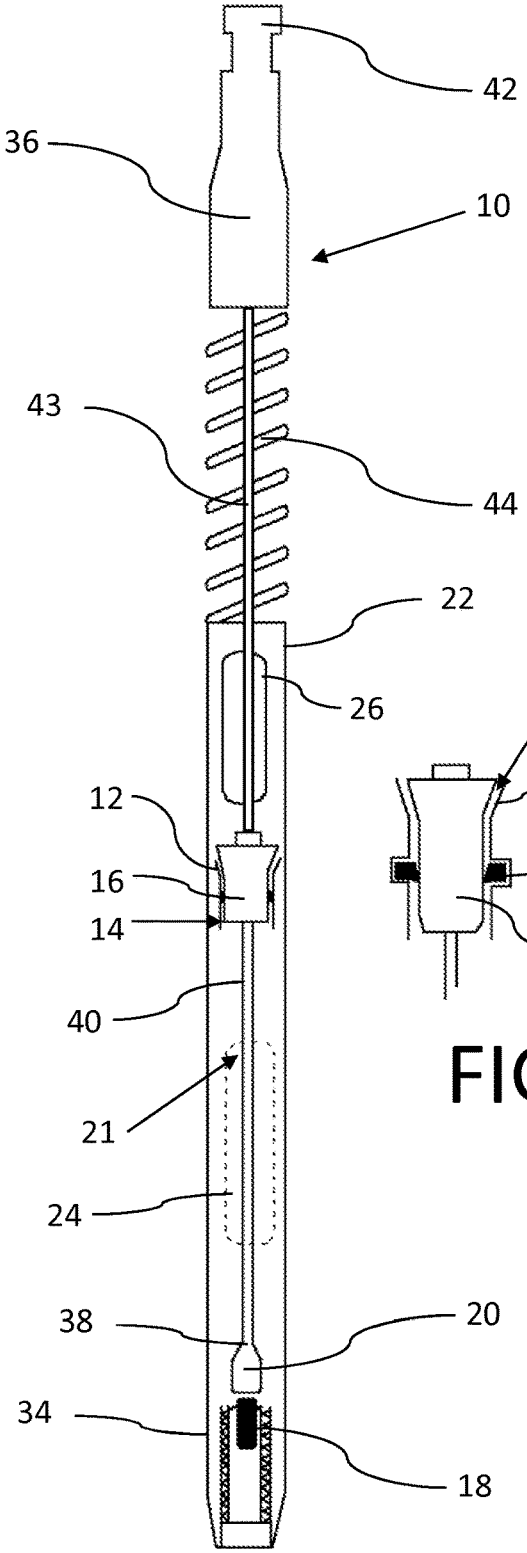
FIG. 2 is a side elevation view, in section, of the downhole valve assembly of FIG. 1, with the valve closure in the closed position.
Figure 2A:
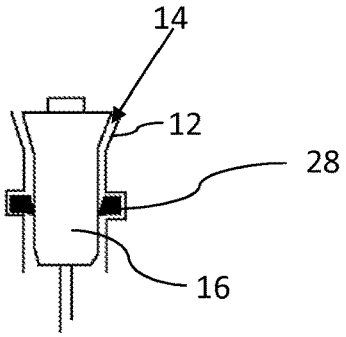
FIG. 2A is a detailed side elevation view, in section, of the valve closure illustrated in FIG. 2.
Figure 3:
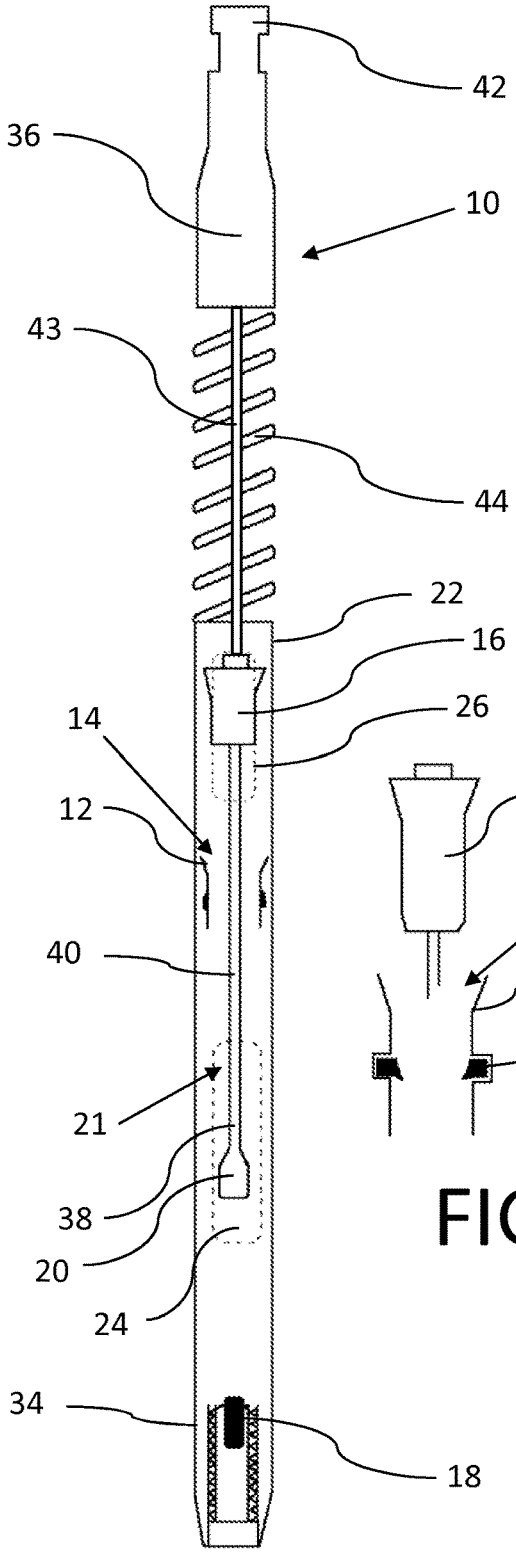
FIG. 3 is a side elevation view, in section, of the downhole valve assembly of FIG. 1, with the valve closure in the open position.
Figure 3A:
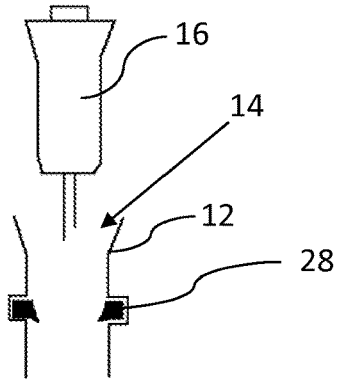
FIG. 3A is a detailed side elevation view, in section, of the valve closure illustrated in FIG. 3.

Structure and Relationship of Parts of First Embodiment:

Referring to FIG. 1 and FIG. 2, downhole valve 10 has a valve seat 12 with at least one gas flow channel 14. A valve closure 16 is be movable between a closed position engaged with valve seat 12 to close gas flow channel 14 (FIG. 2A) and an open position with valve closure 16 spaced from valve seat 12 permitting a flow of gas through gas flow channel 14 (FIG. 3A). A first rare earth magnet 18 and a second rear earth magnet 20 are provided. When valve closure 16 engages valve seat 12, magnets 18 and 20 hold valve closure 16 in the closed position by magnetic attraction. With this configuration, gas is only be able to flow through gas flow channel 14 when gas pressure was sufficient to move valve closure 16 to the open position by overcoming the magnetic attraction of magnets 18 and 20 which otherwise maintains valve closure 16 in the closed position. The configuration of downhole valve 10 can vary.

The configuration selected for illustration has a tubular body 22. There is a gas inflow port 24 that allows gas to flow into interior 21 of tubular body 22 and a gas outflow port 26 that allows gas to exit tubular body 22. Valve seat 12 is positioned between gas inflow port 24 and gas outflow port 26, so gas cannot flow from gas inflow port 24 to gas outflow port 26 when valve closure 16 is in the closed position. Gas flow channel 14 has an annular lip seal 28 that seals with valve closure 16 when valve closure 16 is engaged with valve seat 12. Tubular body 22 has exterior annular seals 30 to prevent gas passing along an exterior 32 of tubular body 22. Tubular body 22 has a first end 34 and a second end 36. Magnet 18 is positioned at first 34. Magnet 20 is mounted at a remote end 38 of a rod 40 that extends from valve closure 16 toward magnet 18. In operation, downhole valve 10 does not cycle up and down the tubing string as would a plunger, it remains positioned at the bottom end of the tubing string engaged with the bottom hole nipple. Second end 36 of tubular body 22 has a fish neck connector 42, so that tubular body 10 may be gripped to remove downhole valve 10 from the well for periodic servicing. Fish neck connector 42 is connected to tubular body 22 by means of rod 43, that has a bumper spring 44 outside of it. Bumper spring 44 is used to absorb the energy of a falling plunger. Rod 43 travels downwards as bumper spring 44 collapses. The upward travel of rod 43 is limited by a stop 45 positioned at a remote end of rod 43.

Operation:

In operation, downhole valve 10 is inserted into a gas well and falls down the tubing string until it rests at the bottom end of the tubing string engaged with the bottom hole nipple. Referring to FIG. 1, gas flow along exterior 32 of tubular body 22 of downhole valve 10 is precluded by the presence of exterior annular seals 30. Referring to FIGS. 2 and 3, this leaves the only path that gas can flow to surface through gas flow channel 14 of valve seat 12. Referring to FIG. 2, valve closure 16 falls by force of gravity into engagement with valve seat 12. It is held in this closed position by an engagement between magnet 18 and magnet 20. Gas flow channel 14 has annular seal 28 that seals against valve closure 16 when valve closure 16 is engaged with valve seat 12. Referring to FIG. 3, when gas pressure exceeds the force of magnetic attraction of magnet 18 and magnet 20, valve closure 16 is forced to an open position, allowing gas to flow through gas flow channel 14. In operation, valve closure 16 will continually cycle between the open position of FIG. 3 and the closed position of FIG. 2; with valve closure 16 remaining in the closed position until the force of magnetic attraction holding it in the closed position is overcome by a buildup of gas pressure.

It was subsequently realized that this concept could be incorporated into existing plunger equipment that cycles up and down, with a plunger receiver serving as the valve seat and a plunger serving as the valve closure. This second embodiment will now be further described with reference to FIGS. 4 and 5.

Figure 4:
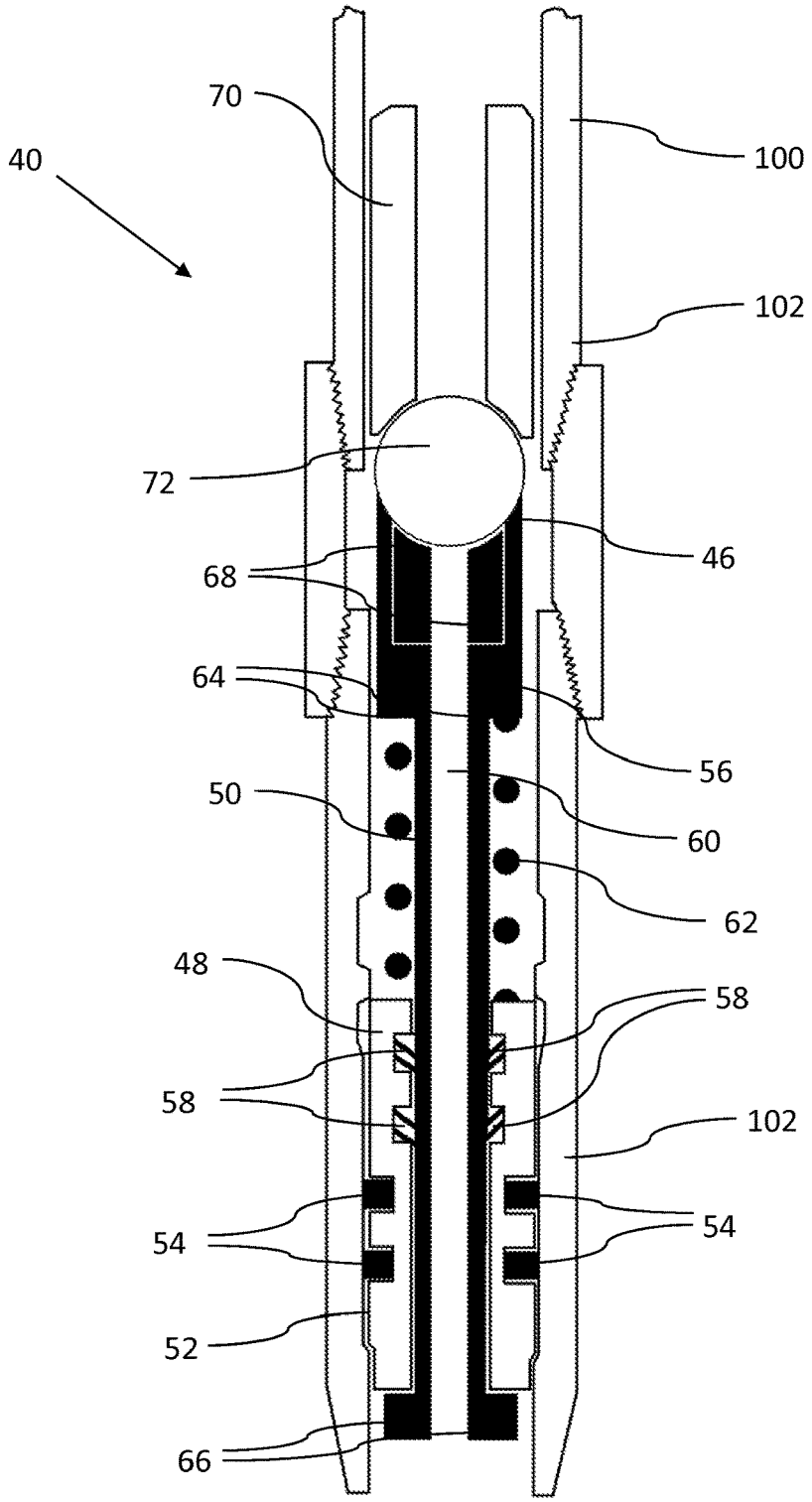
FIG. 4 is a side elevation view, in section, of bottom hole assembly having a plunger receiver serving as a valve seat and a travelling ball serving as a valve closure.
Figure 5:
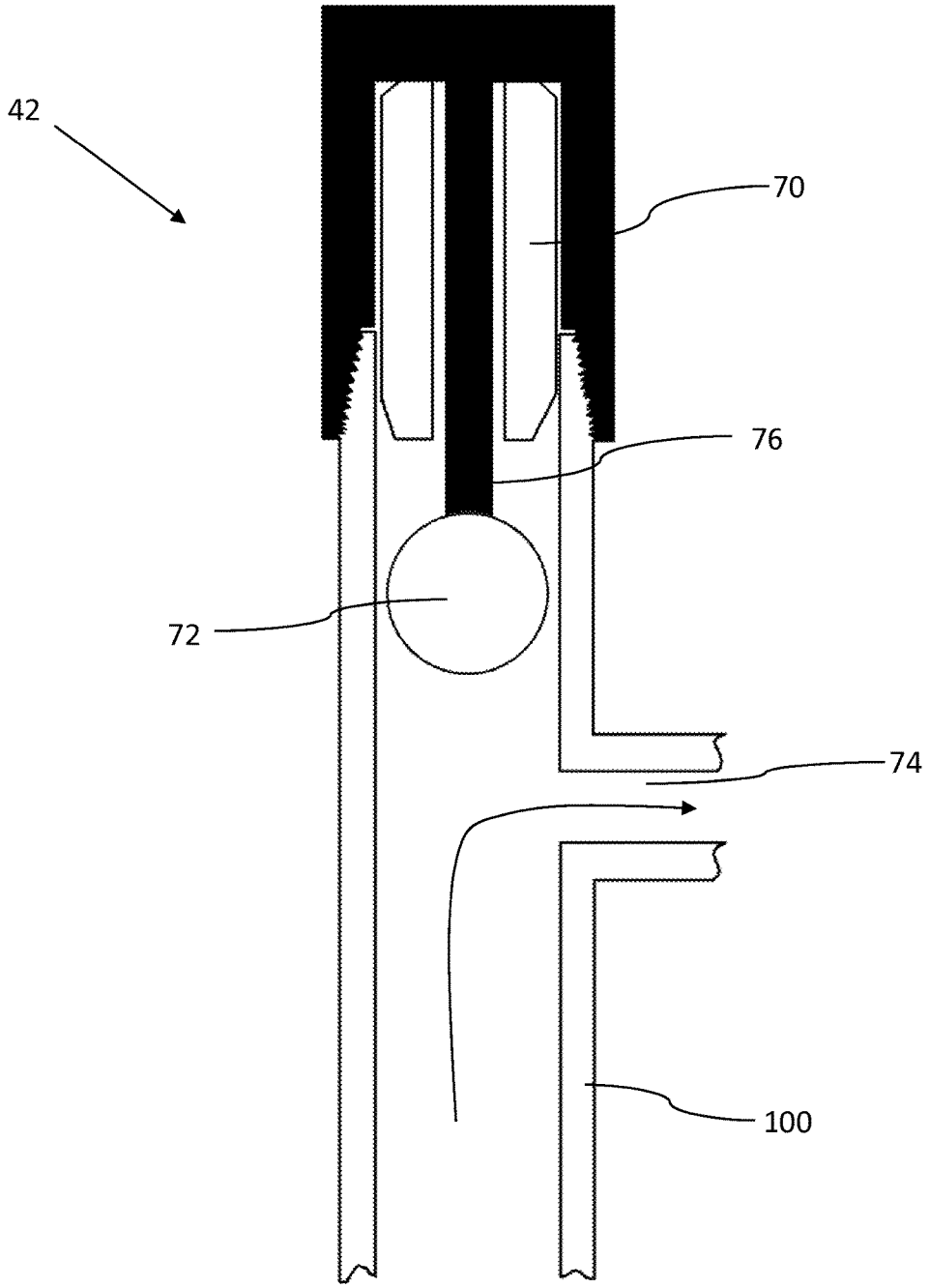
FIG. 5 is a side elevation view, in section, of surface assembly showing gas escaping when the travelling ball has reached the surface assembly.

Structure and Relationship of Parts:

Referring to FIG. 4, there is illustrated a bottom hole assembly 40 of a plunger lift system. Referring to FIG. 5, there is illustrated a surface assembly 42 of a plunger lift system. The valve seat is a plunger receiver 46, which is incorporated into bottom hole assembly 40. Bottom hole assembly 40 is positioned at the bottom end of tubing string 100 engaged with bottom hole nipple 102. Bottom hole assembly 40 has a tubular body 48 with an interior surface 50 and an exterior surface 52. Exterior seals 54 are positioned on exterior surface 52 and prevent gas from passing between exterior surface 52 and bottom hole nipple 102. Plunger receiver 46 (the valve seat) is positioned at an upper end of a hollow rod 56. Interior surface 50 of tubular body 48 has interior seals 58 that prevent gas from passing between interior surface 50 and hollow rod 56. This leaves the only path that gas can pass is up internal gas passage 60 of hollow rod 56. The upper portion of hollow rod 56, has a bumper spring 62 outside of it. Bumper spring 62 is used to absorb the energy of a falling plunger. Hollow rod 56 travels downwards as bumper spring 62 collapses. Hollow rod 56 has upper stop shoulders 64 and lower stop shoulders 66. The downward travel of hollow rod 56 is limited by upper stop shoulders 64. The upward travel of hollow rod 56 is limited by lower stop shoulders 66. Plunger receiver 46 (the valve seat) has a rare earth magnet 68.

The plunger system chosen for illustration is known as a "two piece" plunger system. The first piece is a tubular body 70. The second piece is a travelling ball 72. Travelling ball 72 magnetically engages plunger receiver 46. Travelling ball 72 remains engaged with plunger receiver 46 by force of magnetic attraction blocking gas flow through gas passage 60 of hollow rod 56 until gas pressure builds sufficiently below travelling ball 72 to overcome the magnetic attraction and propel travelling ball to surface.

Referring to FIG. 5, surface assembly 42 has a gas flow passage 74 for receiving the gas. It also has a cavity into which tubular body 70 is received and a trip valve rod 76 which separates travelling ball 72 from tubular body 70 at surface.

Operation:

Travelling ball 72 is held in place on plunger receiver 46 by magnet 68. This allows the reservoir pressure to build up to a point that it overcomes the magnetic force and releases travelling ball 72, allowing the plunger including travelling ball 72 and tubular body 70 to travel to surface. Magnet 68 directly induces a pressure differential between the reservoir and the inside of the tubing string. This embodiment can be incorporated in any plunger style. Some plunger lift styles but not limited to are/standard plungers/flow through plungers/bypass plungers/two piece plungers. In operation this plunger assembly is held in place at the bottom of the tubing string magnetically. The plunger seals the tubing string eliminating any gas by passing the plunger as long as the magnet is holding the plunger in place. When the reservoir pressure builds up to the point that the pressure differential can overcome the magnetic attraction then the plunger is free to travel up the inside of the tubing string to surface. Once the assembly reaches surface the gas is released. The manner of releasing the gas depends upon the plunger style. In the illustrated embodiment, there is a gas flow passage 74. There is also a trip valve rod 76 that separates the plunger components and allows the plunger to return to the bottom of the tubing string once gas pressure is released via gas flow passage 74. Once the plunger reaches the bottom of the tubing string, magnet 68 holds travelling ball 72 to plunger receiver 46 at the bottom of the well bore awaiting a reservoir pressure build up to repeat the cycle.

The preferred approach is to use two magnets. However, it will be appreciated that the functions described could also be accomplished with a single magnet in combination with a second component made of a metal that reacts to the single magnet to create a desired magnetic attraction force. It will also be appreciated that the force of magnetic attraction can be varied through the selection of powers of the magnet or by adjusting the magnet clearance or by the number of magnets that are used.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A method of gas lift, comprising:

securing a valve seat in a fixed position relative to a tubing string in a gas well experiencing hydrostatic loading, the valve seat having a gas flow channel that connects a hydrocarbon producing formation and a production path of the tubing string;

providing a valve closure that is movable between a closed position engaged with the valve seat to close the gas flow channel and an open position spaced from the valve seat permitting a flow of gas through the gas flow channel, the closure being biased by magnetic attraction to a normally closed position magnetically engaged with the valve seat, such that gas is only able to flow through the gas flow channel when a gas pressure differential between the hydrocarbon producing formation and the production path of the tubing string is sufficient to move the closure to the open position by overcoming the magnetic attraction that maintains the closure in the closed position, the valve seat remaining in the fixed position relative to the tubing string when the valve closure is in both the closed position and the open position;

preventing flow from the hydrocarbon producing formation to the production path of the tubing string when the valve closure is in the closed position; and permitting flow from the hydrocarbon producing formation to the production path of the tubing string when the valve closure is in the open position.

2. The method of gas lift of claim 1, wherein the closure falls back from the open position into the closed position by force of gravity as gas pressure diminishes.

3. The method of gas lift of claim 1, wherein the valve seat is a plunger receiver; and the valve closure is a plunger in the gas well that magnetically engages the plunger receiver, the plunger remaining engaged with the plunger receiver by magnetic attraction blocking gas flow to surface until gas pressure builds sufficiently below the plunger to overcome the magnetic attraction and propel the plunger to surface.

4. A gas lift system, comprising:

a plunger receiver secured in a fixed position relative to a tubing string in a gas well; and a plunger in the gas well that magnetically engages the plunger receiver, the plunger remaining engaged with the plunger receiver by magnetic attraction blocking gas flow to surface until gas pressure builds sufficiently below the plunger to overcome the magnetic attraction and propel the plunger to surface, the plunger receiver remaining in the fixed position relative to the tubing string as the plunger moves between the surface and the plunger receiver.

* * * * *